US009272761B2

(12) United States Patent
Farmer

(10) Patent No.: US 9,272,761 B2
(45) Date of Patent: Mar. 1, 2016

(54) ANGULAR VELOCITY-CONTROLLED PONTOON PROPULSION SYSTEM

(71) Applicant: Jerome C. Farmer, Del Mar, CA (US)

(72) Inventor: Jerome C. Farmer, Del Mar, CA (US)

( * ) Notice: Subject to any disclaimer, the term of this patent is extended or adjusted under 35 U.S.C. 154(b) by 0 days.

(21) Appl. No.: 14/467,477

(22) Filed: Aug. 25, 2014

(65) Prior Publication Data

US 2015/0064993 A1 Mar. 5, 2015

Related U.S. Application Data

(60) Provisional application No. 61/933,274, filed on Jan. 29, 2014, provisional application No. 61/870,509, filed on Aug. 27, 2013.

(51) Int. Cl.

| | |
|---|---|
| ***B63B 35/83*** | (2006.01) |
| ***B63H 23/00*** | (2006.01) |
| ***B63H 5/07*** | (2006.01) |
| ***B63B 1/14*** | (2006.01) |
| ***B63H 16/18*** | (2006.01) |

(52) U.S. Cl.

CPC . *B63B 35/83* (2013.01); *B63B 1/14* (2013.01); *B63H 5/07* (2013.01); *B63H 16/18* (2013.01); *B63B 2001/145* (2013.01); *B63H 2016/185* (2013.01)

(58) Field of Classification Search

CPC ..... B63B 35/83

USPC ..... 441/76

See application file for complete search history.

(56) References Cited

U.S. PATENT DOCUMENTS

| | | | | | |
|---|---|---|---|---|---|
| 356,846 | A | | 2/1887 | Martin | |
| 791,852 | A | | 6/1905 | Worcester | |
| 1,006,118 | A | | 10/1911 | Napier | |
| 1,384,354 | A | | 7/1921 | Sheldon | |
| 1,475,031 | A | | 11/1923 | Sheldon | |
| 1,693,867 | A | | 12/1928 | Reinwald | |
| 1,719,059 | A | | 7/1929 | Krupka et al. | |
| 1,894,874 | A | | 1/1933 | Kask | |
| 2,153,939 | A | * | 4/1939 | Schaupp | B63B 35/83 441/77 |
| 2,507,469 | A | | 5/1950 | Hanson | |
| 2,808,802 | A | | 10/1957 | Graham | |
| 2,873,713 | A | | 2/1959 | Baastrup | |
| 2,940,090 | A | * | 6/1960 | Fournier | B63B 35/83 441/77 |
| 3,007,434 | A | | 11/1961 | Laycox | |
| 3,034,157 | A | | 5/1962 | Abajian | |
| 3,242,898 | A | * | 3/1966 | Livaudais | B63B 35/83 122/451 R |
| 3,479,674 | A | | 11/1969 | Beymer | |
| 3,541,623 | A | | 11/1970 | Duda | |
| 3,566,427 | A | | 3/1971 | Davis et al. | |
| 3,609,782 | A | | 10/1971 | Mabuchi | |
| 3,835,494 | A | | 9/1974 | Dougherty | |
| 3,877,409 | A | * | 4/1975 | Krogseng | B63B 35/83 440/25 |
| 4,004,543 | A | | 1/1977 | Cox | |
| 4,043,291 | A | | 8/1977 | Bearup et al. | |
| 4,129,912 | A | | 12/1978 | Robinson | |
| 4,295,236 | A | | 10/1981 | Upchurch | |
| 4,459,118 | A | | 7/1984 | Schaumann | |
| 4,541,809 | A | * | 9/1985 | Schaumann | B63H 16/08 441/76 |

(Continued)

*Primary Examiner* — Lars A Olson

*Assistant Examiner* — Jovon Hayes

(74) *Attorney, Agent, or Firm* — Dinsmore & Shohl LLP; Douglas L. Wathen

(57) ABSTRACT

An apparatus for floatation and propulsion of a user on a body of water, with the user in a standing position, includes two pontoons, a mechanical connection of the pontoons and a propulsion system responsive to vertical articulation of the pontoons.

18 Claims, 13 Drawing Sheets

(56) References Cited

U.S. PATENT DOCUMENTS

| | | | | | |
|---|---|---|---|---|---|
| 4,599,072 | A | | 7/1986 | Pollini et al. | |
| 4,618,329 | A | | 10/1986 | Celez | |
| 4,624,646 | A | | 11/1986 | Strohmeier | |
| 4,698,039 | A | | 10/1987 | Watson | |
| 4,804,345 | A | | 2/1989 | Lee | |
| 4,915,659 | A | | 4/1990 | Sanders | |
| 5,080,621 | A | | 1/1992 | Nayes | |
| 5,120,249 | A | | 6/1992 | Fonda | |
| 5,145,424 | A | | 9/1992 | Han | |
| 5,192,237 | A | | 3/1993 | Pegoraro et al. | |
| 5,236,381 | A | | 8/1993 | Keogh | |
| 5,387,143 | A | | 2/1995 | Pitman | |
| 5,421,759 | A | | 6/1995 | Morin et al. | |
| 5,462,466 | A | | 10/1995 | Hull et al. | |
| 5,593,334 | A | | 1/1997 | Thayer | |
| 5,607,331 | A | * | 3/1997 | Lekhtman | B63H 11/06 440/23 |
| 5,616,060 | A | * | 4/1997 | Morin | B63B 35/83 441/76 |
| 5,697,822 | A | | 12/1997 | Souter | |
| 5,702,274 | A | | 12/1997 | White | |
| 5,860,841 | A | * | 1/1999 | Welz | B63H 16/10 441/76 |
| 5,896,824 | A | | 4/1999 | Barnes, Jr. | |
| 5,988,098 | A | | 11/1999 | Hillhouse | |
| 6,146,218 | A | | 11/2000 | White | |
| 6,264,519 | B1 | | 7/2001 | Brown | |
| 6,468,118 | B1 | * | 10/2002 | Chen | B63H 1/36 114/61.1 |
| 6,595,813 | B1 | * | 7/2003 | Lekhtman | B63H 16/12 440/21 |
| 6,764,363 | B2 | | 7/2004 | Rosen | |
| 6,855,024 | B2 | | 2/2005 | Rothschild | |
| 6,871,608 | B2 | | 3/2005 | Rosen | |
| 7,121,910 | B2 | * | 10/2006 | Rosen | B63B 35/83 441/76 |
| 7,232,350 | B1 | | 6/2007 | Krah | |
| 7,311,573 | B1 | | 12/2007 | Dillenschneider | |
| 7,354,326 | B2 | * | 4/2008 | Lukens | B63B 1/125 114/123 |
| 7,607,959 | B2 | | 10/2009 | DeMint | |
| 7,789,035 | B1 | | 9/2010 | Rosenberg et al. | |
| 7,955,150 | B2 | | 6/2011 | Friedrich | |
| 8,043,134 | B2 | | 10/2011 | Krah | |
| 8,438,985 | B2 | | 5/2013 | Scadden | |
| 2003/0017769 | A1 | * | 1/2003 | Rosen | B63B 35/83 441/76 |
| 2012/0244764 | A1 | | 9/2012 | Farmer | |
| 2013/0042799 | A1 | | 2/2013 | Baldwin | |
| 2015/0064993 | A1 | * | 3/2015 | Farmer | B63B 35/83 440/1 |

* cited by examiner

ANGULAR VELOCITY-CONTROLLED PONTOON PROPULSION SYSTEM

CROSS-REVERENCE TO RELATED APPLICATIONS

This application claims priority to U.S. provisional patent application Ser. Nos. 61/870,509, filed Aug. 27, 2013, and 61/933,274, filed Jan. 29, 2014, which are incorporated herein in their entirety.

FIELD OF THE INVENTION

The present invention relates generally to apparatus for floatation and propulsion of a user on a body or water.

BACKGROUND OF THE INVENTION

When people use devices to stand on the water, they usually either use the movement of the water (i.e. surfing), the wind (i.e. windsurfing or kite surfing) or their arms (i.e. standup paddleboarding) to propel them. Less commonly, people have used the forward and backward sliding movement of pontoons to provide motion.

The forward and backwards sliding of pontoons has drawbacks of stability and efficiency. It requires the user to move his or her legs forward and backwards at the same time as balancing as waves come from all directions.

SUMMARY OF THE INVENTION

The present invention provides various embodiments of an apparatus that produces forward motion when a user standing on two pontoons shifts her or her weight between the pontoons, causing angular and/or vertical motion between the pontoons as viewed from fore or aft. The user's movement causes the pontoons to move generally vertically, but may also move laterally as controlled by the invention's mechanical connections. The pontoons are generally kept parallel to each other. The change of the relative position of the two pontoons, as viewed from the fore or aft, may be used to control a propeller. In some embodiments, sensors, either electrical or mechanical, continuously sample the position of the pontoons, either directly by measuring the pontoons or by measuring mechanical connections to the pontoons. The speed at which the user is moving the pontoons by shifting his or her weight between them is calculated, including accounting for the movement of the water, and the calculated angular speed is used as an input to control the rate of rotation of a propeller. The faster the movement, the more propulsion, although the relationship may not be linear. There may also be a rotational-velocity sensor on the propeller shaft that provides feedback to help stabilize the apparatus and control the propeller's speed. Resistance to the rotation of the mechanical joints may be controlled by the user, thereby determining the physical force required to change the relative position of the pontoons. Fins may add additional stability. An electrical system, including buttons, visual displays, and audio signals, may be included to increase the user's control over the invention.

In some embodiments, a center bar is held between the two pontoons by a mechanical device of hinges and struts. A center unit is mounted on this center bar in such a way that it can rotate laterally (i.e. swivel) in relation to the center bar. The angle and distance between the pontoons is physically constrained by the angle between the center bar and the center unit. Thus, a wave can tilt the entire invention, but the relative position between the pontoons is always determined by the angle between the center unit and the center bar. This later angle can then be used to control the propeller speed.

BRIEF DESCRIPTION OF THE DRAWINGS

Other objects, features and advantages of the invention will become apparent from the following description in conjunction with the accompanying drawings, wherein.

DETAILED DESCRIPTION OF THE INVENTION

The present invention provides an apparatus for floatation and propulsion of a user on a body of water. The user stands upon two pontoons with a foot in a chamber in each pontoon. When the user shifts his or her weight between the pontoons, the angle of the pontoons relative to the horizon changes as viewed from fore or aft of the invention. A mechanical apparatus keeps the pontoons longitudinally parallel, so the angles that change are on a longitudinal axis (thus viewed from the fore or aft). Not only do the pontoon angles change relative to the horizon, but also the relative position of the tops of the pontoons changes. The invention provides a mechanical connection between the pontoons that fixes the geometric relation between the pontoons and also adds stability. As the user shifts his or her weight between the pontoons, the change of position between the pontoons is sensed, either directly or indirectly, and the rate of this change is used to control the force of the propulsion on the invention. The faster the user moves the pontoons in a generally upward and downward motion, the greater the force of propulsion. The user may also use paddles to add additional propulsion and stability. In the illustrated embodiment, the pontoons do not move longitudinally relative to each other. In alternative embodiments, a circular or sliding mechanism may provide the user's legs a different ergonomic movement by providing some longitudinal movement to the pontoons, but this longitudinal movement will not control the force of propulsion.

Figure 1:
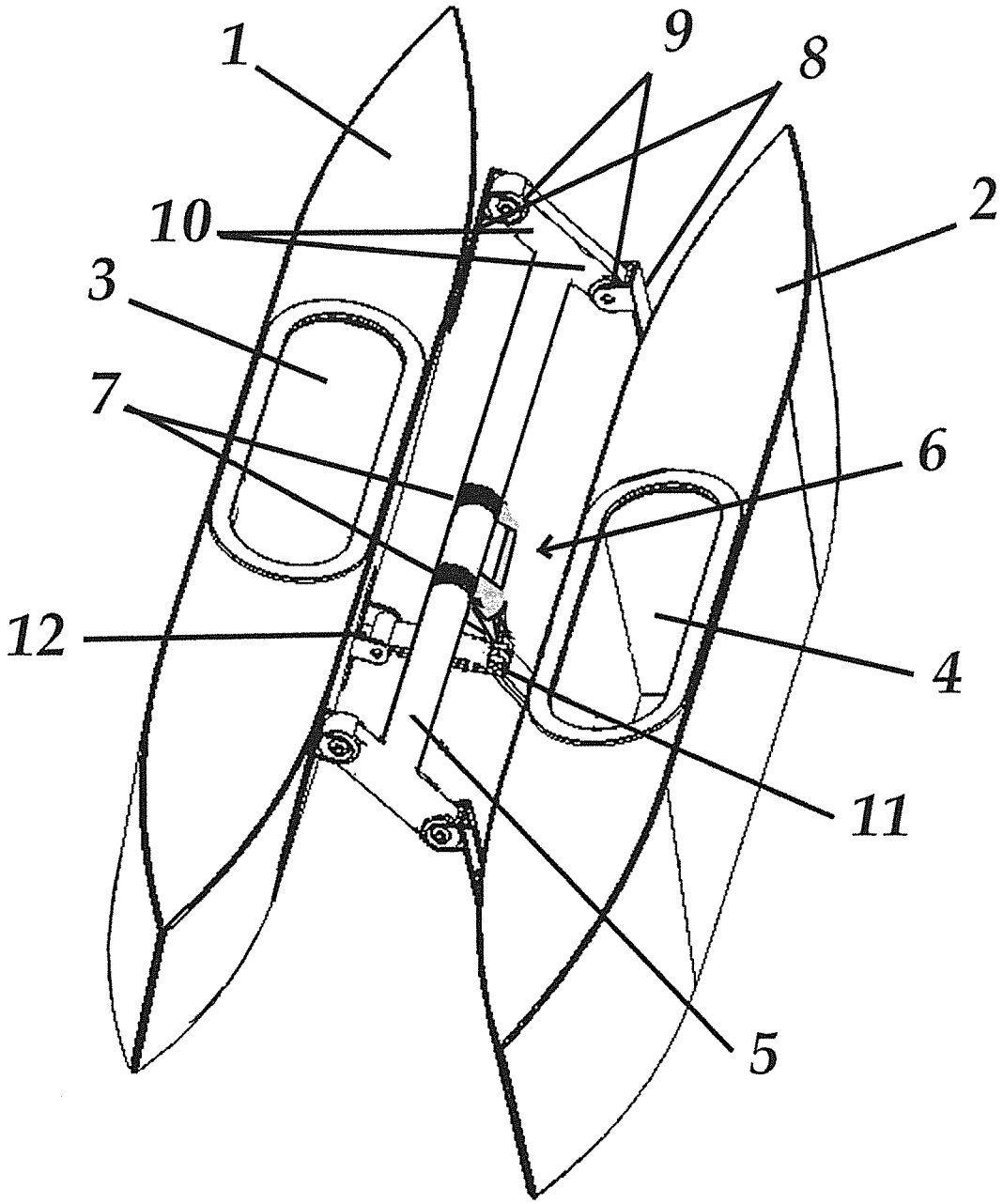
FIG. 1 is a perspective view of an apparatus for floatation and propulsion on a body of water in accordance with an embodiment of the present invention.

Referring to FIG. 1, a first embodiment of an apparatus for floatation of a user on a body of water is shown. Two pontoons, a port pontoon 1 and a starboard pontoon 2 each have a foot chambers, 3 and 4, respectively, to receive the user's feet. A center bar 5 is between the pontoons and parallel to the pontoons. A center unit 6 is attached to the center bar by center unit swivels 7 which align the center bar and center unit to be parallel.

In this embodiment, each pontoon has two pontoon mounting struts 8, on the pontoon's inner side. Pontoon to center bar hinges 9 connect the pontoon mounting struts to center bar struts 10 which extend laterally from the center bar 5. A three-connection hinge 11 is positioned below the center unit. It is attached to the center unit and two pontoon to center unit hinges 12.

Figure 2A:
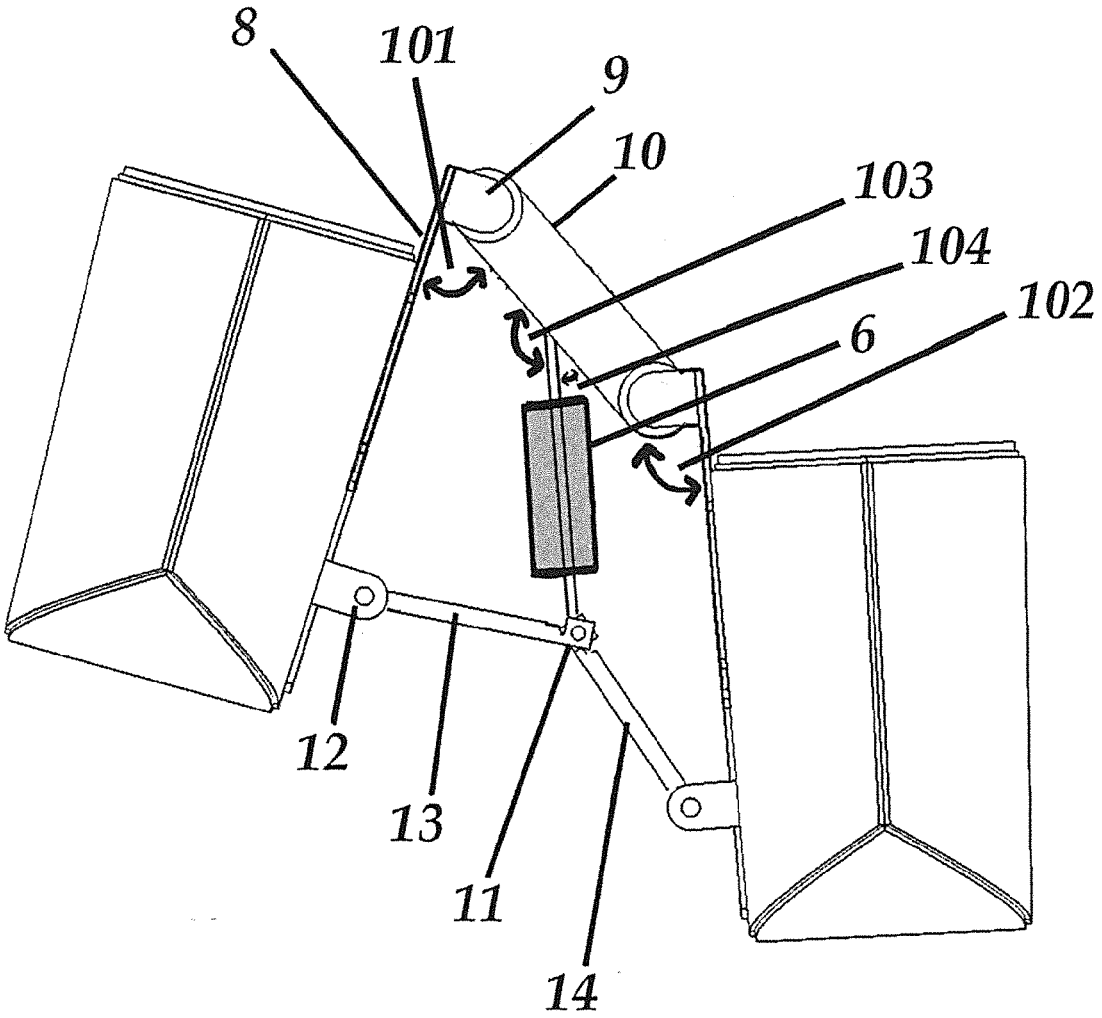
FIG. 2A is a rear view showing a center unit connected between two pontoons.

FIG. 2A shows an aft view of the mechanical connections between the pontoons. The three-connection hinge 11 can be seen to attach the center unit 6, a port pontoon bar 13 and a starboard pontoon bar 14. This figure illustrates the user having more weight on the starboard pontoon, and thus it is lower than the port pontoon. The starboard pontoon is also more vertical, while the port pontoon is tilted inward. This position causes the angle 101 between the port mounting struts 8 and the center bar struts 10 to be smaller than the corresponding angle 102 on the starboard side. The geometry of the invention simultaneously causes the angles between the center bar and the center unit to change. Thus angle 103 between the center bar strut 10 and center unit 6 on the port side is larger than the corresponding angle 104 on the starboard side.

As will be clear to those of skill in the art, the present invention is designed for use in a body of water. The surface of the water may be considered to be generally horizontal. However, references herein to vertical, horizontal, up, down and other directional references are merely for convenience, as the apparatus may be oriented in ways other than illustrated.

Figure 2B:
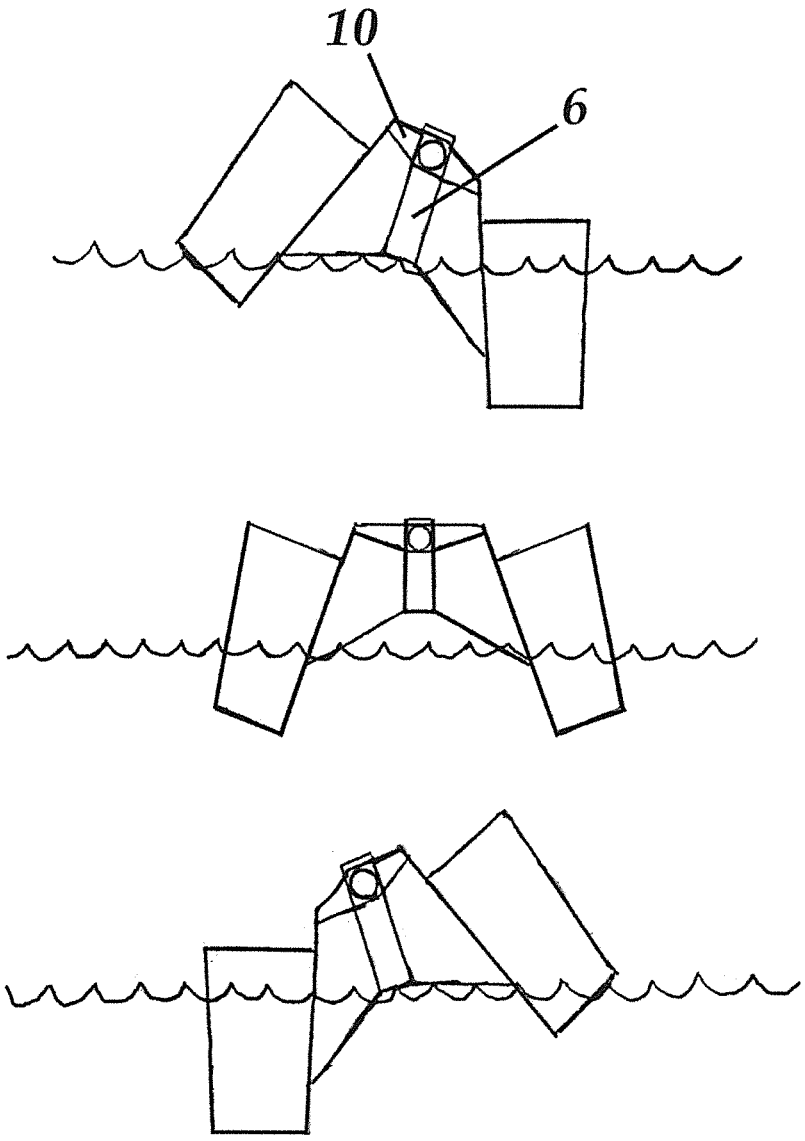
FIG. 2B is a series of schematic rear views of an apparatus in accordance with the present invention showing the positions of the pontoons in a body of water as a user moves their weight from a starboard pontoon to a port pontoon.

FIG. 2B is a series of schematic rear views of an apparatus in accordance with the present invention showing the positions of the pontoons in a body of water as a user moves their weight from a starboard pontoon to a port pontoon. The uppermost view shows the position of the apparatus when the user's weight is on the starboard pontoon. As shown, the starboard pontoon is lower than the port pontoon. This may be considered a down position. the port pontoon is higher and may be considered to be in an up position. The middle view shows the position of the apparatus as the user is shifting his or her weight from the starboard pontoon to the port pontoon, and the pontoons are equally weighted. The mechanical system interconnecting the pontoons has articulated from the "starboard down/port up" position to a neutral position. The lower view shows the position of the apparatus after the user has shifted his or her weight to the port pontoon and the mechanical system has articulated to a "port down/starboard up" position. As shown, the pontoons articulated generally vertically between an up and a down position, passing through a neutral position. There may be more than one up and one down position, since the user may not articulate the pontoon to the limit of its vertical travel. Any position above neutral may be considered an up position and any position below neutral may be considered a down position. The mechanical system articulates such that upward movement of one pontoon is tied to and coordinated with downward movement of the other pontoon. It should be noted that the up and down positions are not merely with reference to the water level, since a user or wave could rock the apparatus side to side without articulating the mechanical system. Instead, the up and down positions are with respect to the neutral position of the mechanical system and pontoons. As shown in the middle view, the pontoons in the neutral position are each angled outwardly, with respect to each other and the mechanical system. Put another way, an upper portion of each pontoon is tilted inwardly with respect to the lower portion. The pontoons may be said to move "generally vertically" relative to each other and the mechanical system that interconnects them. The descriptor "generally vertically" is not limited to purely vertical movement, but encompasses more complex movements such as illustrated, it which a component of the motion is vertical. As also can be seen by comparing the views in FIG. 2B, the pontoons each tilt further inwardly as they move from the neutral position to an up position and tilt outwardly (compared to the neutral position) when moving from the neutral position to a down position. The outward tilt of the pontoons provides enhanced stability and a better operational feel to the apparatus.

Figure 3:
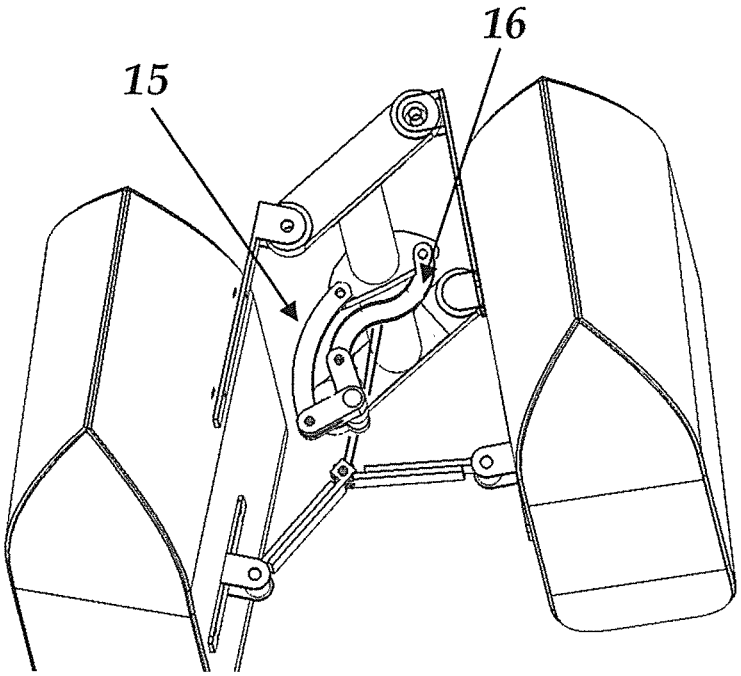
FIG. 3 is a rear perspective of an embodiment of the apparatus with mechanical linkage being moved by the angle between the pontoons.

FIG. 3 illustrates an embodiment of the invention in which the angle between the center bar and the center unit controls a mechanical linkage. When the pontoons shift in a generally vertical motion, the linkage moves. Non-crossing linkage 15 is shown on the left side, in which the hinges and bars are all on one side of the center unit. Crossing linkage 16 is shown which is on the right side of the center unit at the top of the linkage, but crosses under the center bar and is on the left side of the center bar at the bottom of the linkage.

Figure 4:
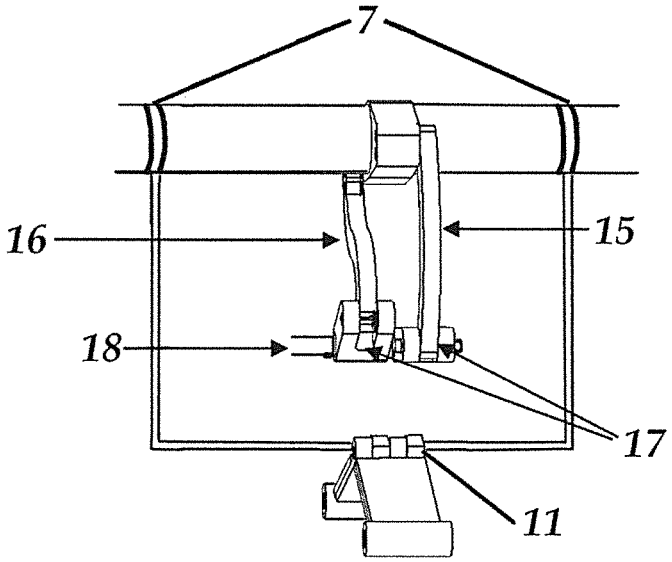
FIG. 4 is a side view of mechanical linkage attached to a center bar.

FIG. 4 is a side view of the linkage showing how the non-crossing linkage 15 and crossing linkage 16 are both connected to a shaft 18. One-way clutches 17 are inside the linkages where they connect with the shaft. Thus the shaft will only turn in one direction.

Figure 5:
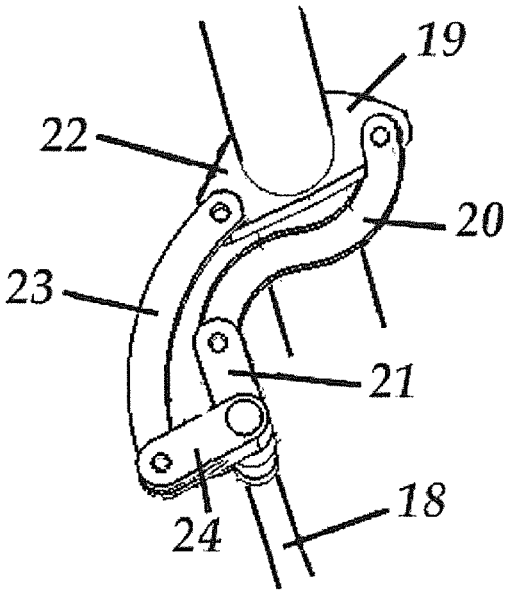
FIG. 5 is an aft perspective of the details of a linkage system connected to a center bar and a one-directional shaft.

FIG. 5 is an aft perspective view showing the details of the linkage systems. Both the non-crossing and crossing system contain three elements: a linkage bar mount (connected to the center bar), a bottom linkage bar (connected to the one-directional shaft) and center linkage bar (between them). If we are using a left-handed propeller (which turns counter-clockwise as viewed from the aft) then this figure shows the one-directional shaft being driven whenever a pontoon moves downward. In this case, when the port (left in the figure) pontoon is lowered, the center bar rotates counter-clockwise (as seen from the aft). This causes the non-crossing linkage bar mount 22 to move downward, which causes the non-crossing center linkage bar 23 to move downward, which causes the non-crossing bottom linkage bar 24 to rotate counter-clockwise. The same motion also causes the crossing linkage bar mount 19 to move upward, which causes the crossing center linkage bar 20 to move upward, which causes the crossing bottom linkage bar 21 to rotate clockwise.

There is a one-way clutch in both of the bottom linkage bars 24 and 21. Both of these clutches turn the one-directional shaft 18 in the same direction, (in this case counter-clockwise), and disengage in the other direction. Therefore, when the port pontoon lowers, the non-crossing bottom linkage bar moves the one-directional shaft in a counter-clockwise motion and the crossing bottom linkage bar disengages. When the starboard pontoon lowers, the opposite happens, and the crossing linkage system drives the shaft.

Figure 6:
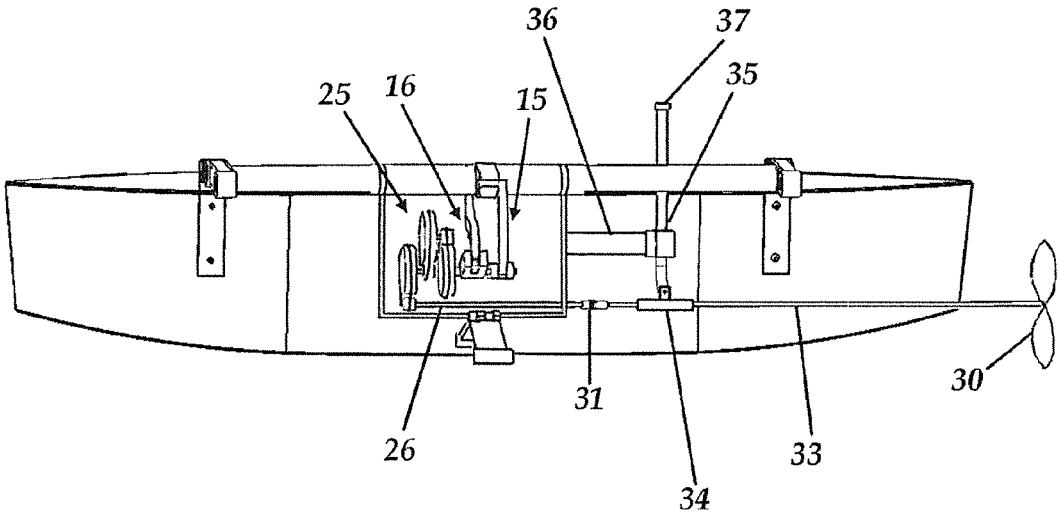
FIG. 6 is a side view of a portion of the apparatus showing a linkage system and a propeller raising system.

FIG. 6 is a side view showing the linkage systems driving gears 25 which turn a jackshaft 26. These gears may consist of bands, cables or chains. The gears are supported by a gearbox which is part of the center unit. Therefore, the movement of the center bar relative to the center unit turns a jackshaft.

The jackshaft 26 may be connected to the propeller shaft 33 through a U-joint 31. The propeller shaft may be lifted to different angles using a vertically adjustable propeller shaft strut bearing 34. The propeller shaft strut bearing is raised relative to the gearbox. This may be accomplished by a propeller shaft lifting bar 35 which is supported by a propeller shaft lifting strut 36. The propeller shaft lifting bar has a handle 37 designed to be pulled from the user standing on the pontoons.

Figure 7:
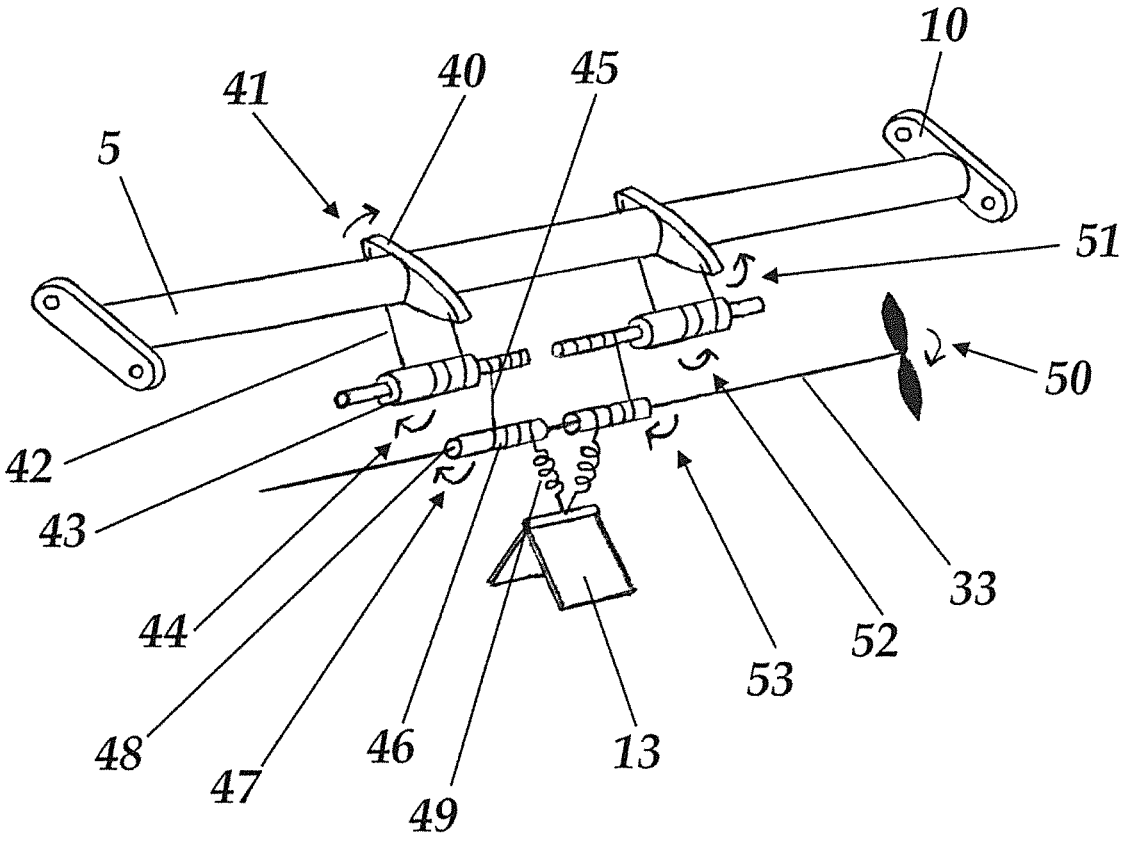
FIG. 7 is an exploded perspective view of a portion of an embodiment of the apparatus in which the angle of the center bar pulls cables and springs in order to turn a propeller.

In FIG. 7, the motion of the pontoons drives a system of cables and springs rather than a linkage system. This figure is a perspective view from the port side and in front of the invention, so the clockwise and clockwise directions are measured from the front. Several cable drums are housed within the center unit and the mechanical connections between the pontoons, center bar, and center unit are the same as other embodiments of the invention. Whenever one of the pontoons is lowered, one of the springs turns the propeller while the other spring is stretched. Lowering the port pontoon creates a clockwise (as sent from the front) force 41 on the center bar. This causes the fore cable mounting strut 40 to rotate clockwise. A fore center bar cable 42 is connected on each side of the fore cable mounting strut and also winds around the fore center bar cable drum 43. Therefore the cable 42 turns the cable drum 43 in a clockwise direction 44. Another cable, the fore spring cable 45 is wound about both the fore center bar cable drum 43 and the fore spring cable drum 46. The clockwise rotation of the fore center bar cable drum 43 turns the fore spring cable drum 46 in a clockwise direction 47. A fore spring 49 may be attached between the fore spring cable drum 46 and the three-connection hinge connected to the pontoons. A one-way clutch 48 is inside the fore spring cable drum 46, so the downward force of the port pontoon creates a clockwise force 50 on the propeller shaft and propeller.

When the starboard pontoon is lowered, a counterclockwise force 51 is created on the aft cable mounting strut, which creates a counterclockwise force 52 on the aft center bar cable drum. The aft spring cable is connected so a counterclockwise force on the aft center bar cable drum creates a clockwise force 53 on the aft spring cable drum, also turning the propeller clockwise.

Figure 8:
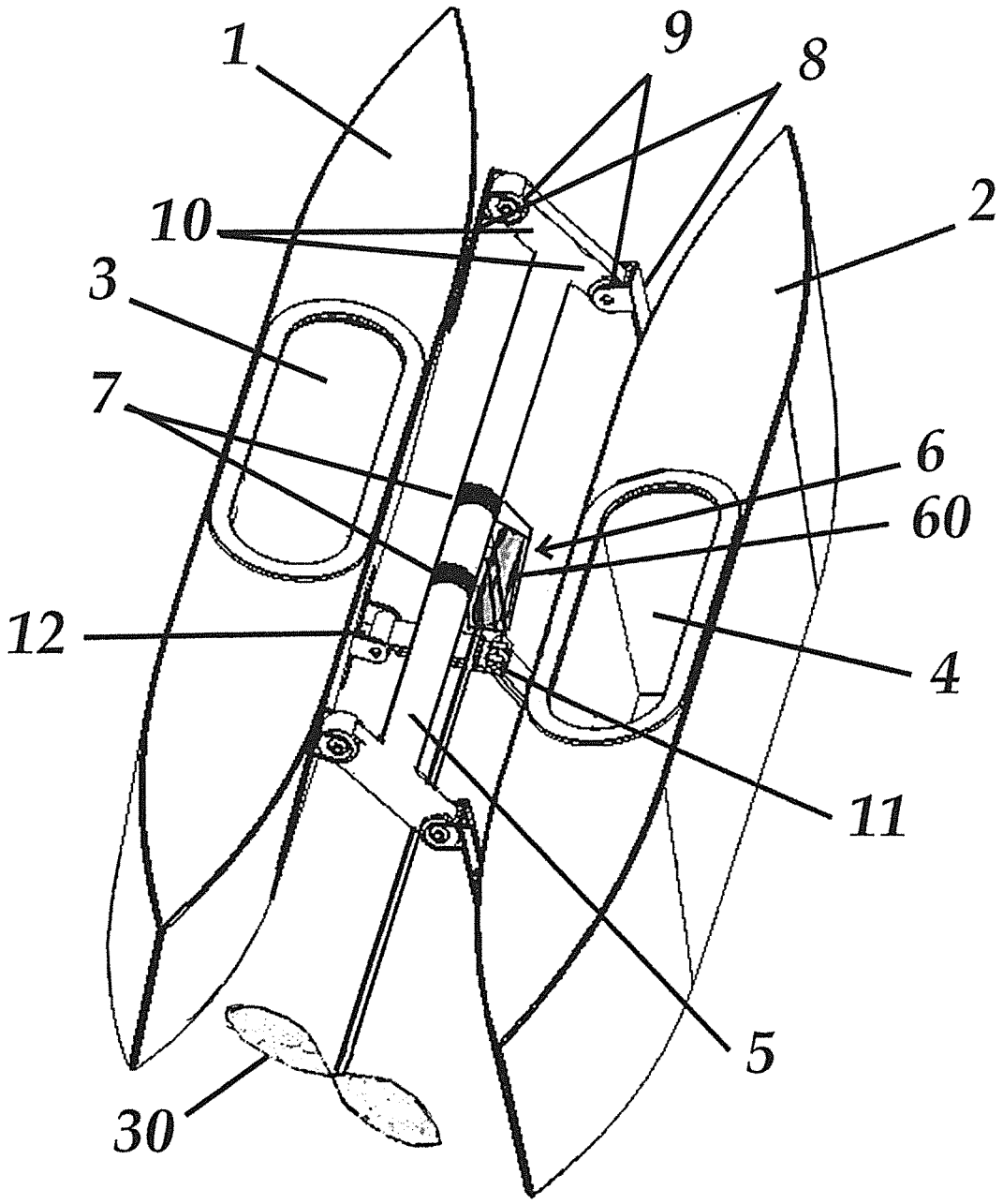
FIG. 8 is a perspective view of an embodiment of the apparatus with a motor attached to the center unit.

FIG. 8 shows an alternative embodiment with a motor 60 attached to the center unit. Elements of each embodiment of the present invention that are the same or similar to an earlier embodiment use the same numbers for the same elements. In this case, the relative position of the pontoons is measured with electrical sensors instead of mechanical connections. The electrical sensors may be accelerometers, gyros, GPS systems, other sensors, or a combination of these. The sensors can be placed directly on the pontoons, or they can be placed on the center bar or center unit and measure the relative position of the pontoons indirectly. The motor rotates a propeller 30. The motor may be the only force on the propeller shaft, or it may be used in unison with a linkage or cable system in which case it assists the physical force applied by the user.

Figure 9:
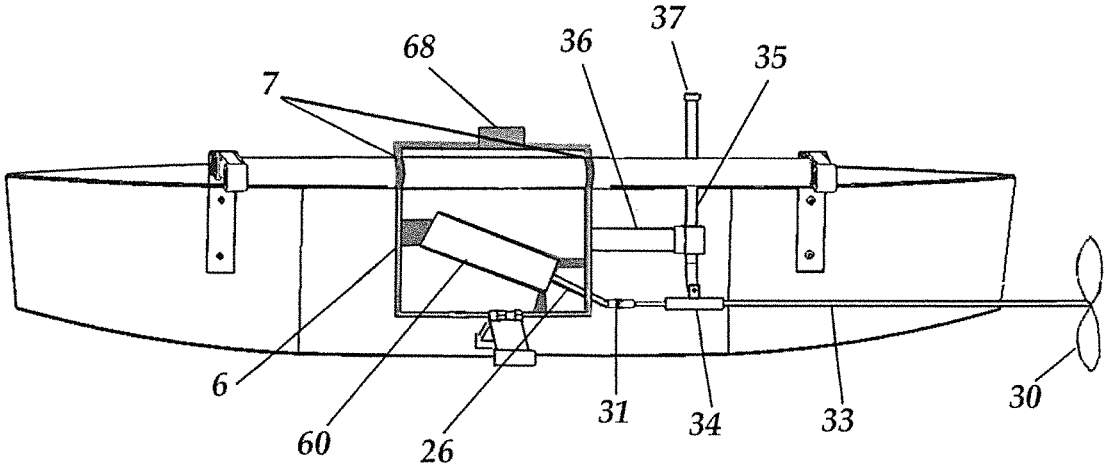
FIG. 9 is a side view of a portion of the apparatus showing the motor attached to the center unit and the propeller raising system.

FIG. 9 illustrates an embodiment of the apparatus in which the propeller can be raised or lowered. A U-joint 31 connects the jackshaft 26 and the propeller shaft 33. A propeller shaft strut bearing 34 can be moved upward by raising the propeller shaft lifting bar 35. This propeller shaft lifting bar is connected to the center unit by horizontal propeller lifting shaft 36, which is connected to the center unit 6 under the center bar, but is connected off-center laterally so the propeller shaft lifting bar does not intersect the center bar. Pulling the handle 37 lifts the propeller shaft strut bearing in a plane aligned to the center unit so the propeller does not hit a pontoon. A microprocessor-controlled logic unit 68 is attached to the center unit above the center unit swivels. This logic unit may contain the signals controlling the motor, the sensors to measure movement, audio systems, circuitry to analyze propeller feedback, and other electrical components. Firmware or software decodes the signals from the electrical sensors, and then filters out noise from the data. Then it uses a function, a two dimensional curve $y=f(x)$, in which x is the angular velocity between the pontoons and y is the power to supply to the motor using pulse width modulation. There may be additional calculations to determine how fast to increase and decrease wattage to the motor. Also, the electric sensors may tell if the bow rises higher or faster than specified amounts, which signals the user has fallen and disables the motor.

Figure 10:
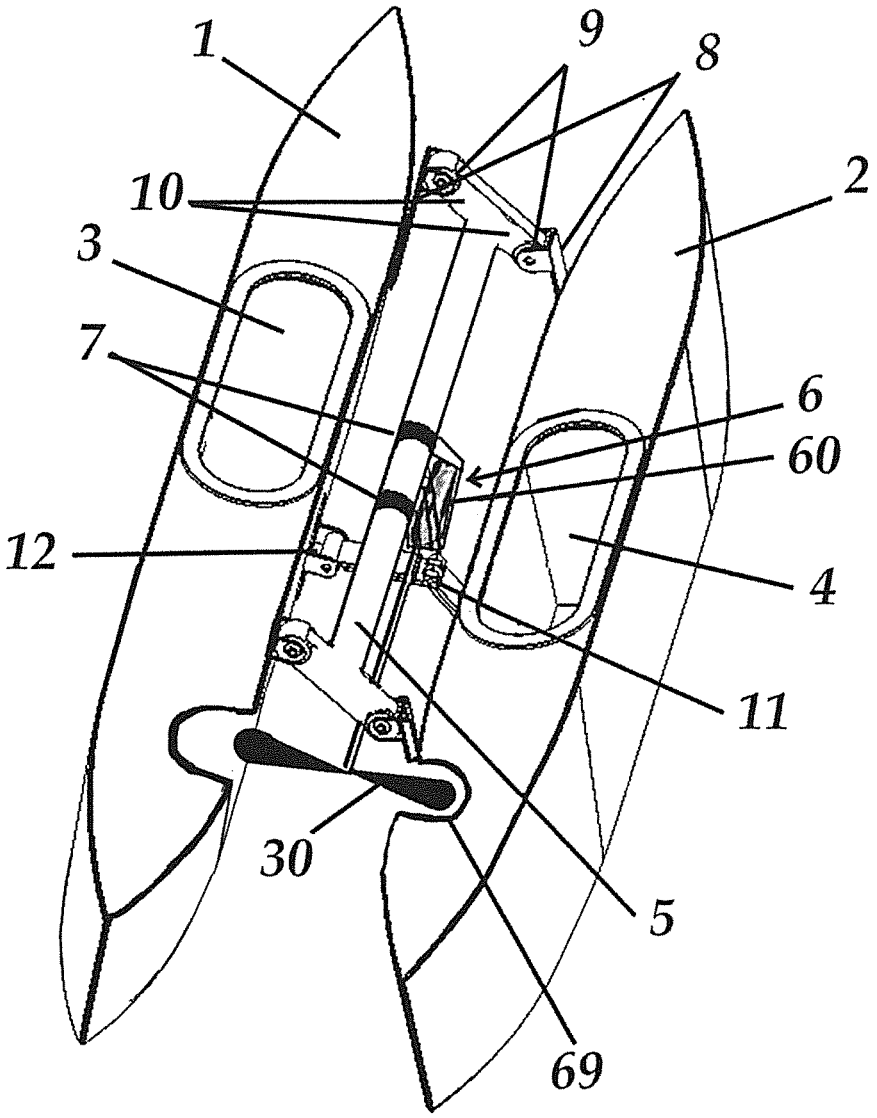
FIG. 10 is a perspective view of an embodiment of the present invention with the pontoons altered to fit a propeller between them.

FIG. 10 shows indentations 69 in the pontoons so the propeller can be moved closer to the center unit in this embodiment of the apparatus.

Figure 11A:
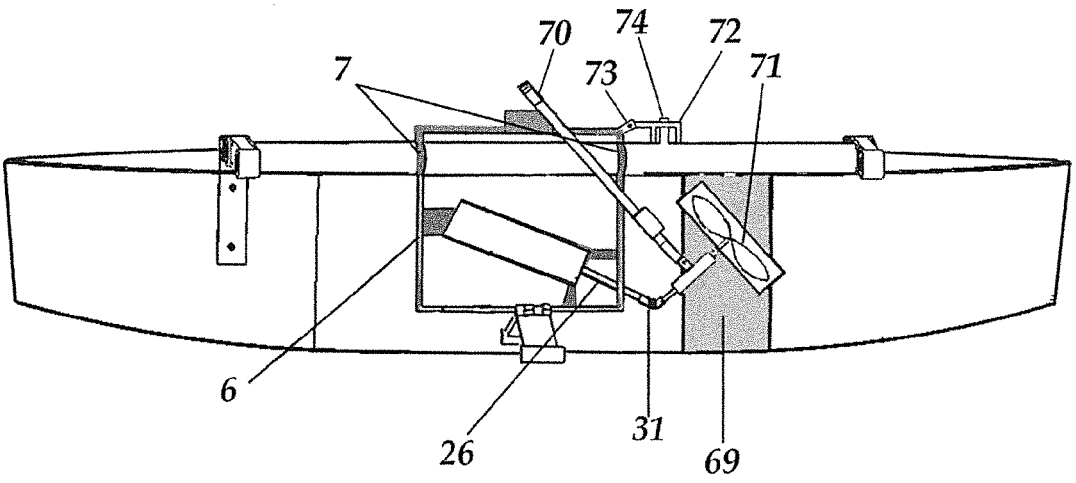
FIG. 11*a* is a side view of a propulsion system utilizing a pivot to raise the propeller system and a locking mechanism to prevent the angle between the pontoons from changing.

FIG. 11*a* illustrates a propeller pivoting lever 70 that allows the propeller system 71 to be tilted. This propeller system may include a cylindrical housing containing the blades of the propeller. A locking mechanism 72 can be used to prevent the center unit from swiveling on the center bar. The locking mechanism is connected to a lock hinge 73 and has a slot or hole that can be placed over a protrusion 74 on the center bar. In FIG. 11*a*, the lock is shown in a down position so the center unit cannot swivel and thus the relative position of the pontoons is fixed.

Figure 11B:
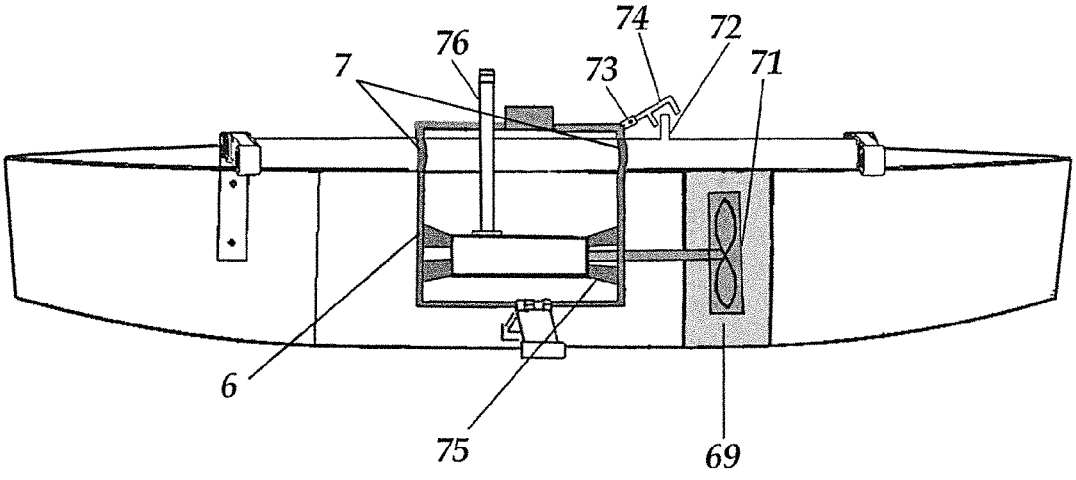
FIG. 11*b* is a side view with the propeller system and the motor being able to be raised vertically and the locking mechanism unlocked so the center unit can swivel.

FIG. 11*b* shows the lock open. It also illustrates an embodiment of the apparatus in which the motor and the propeller system can be raised vertically together. The motor is connected to the center unit 6 by mounts 75 that can slide on the center unit. Raising the motor lifting bar 76 raises the motor and the propeller.

Figure 12:
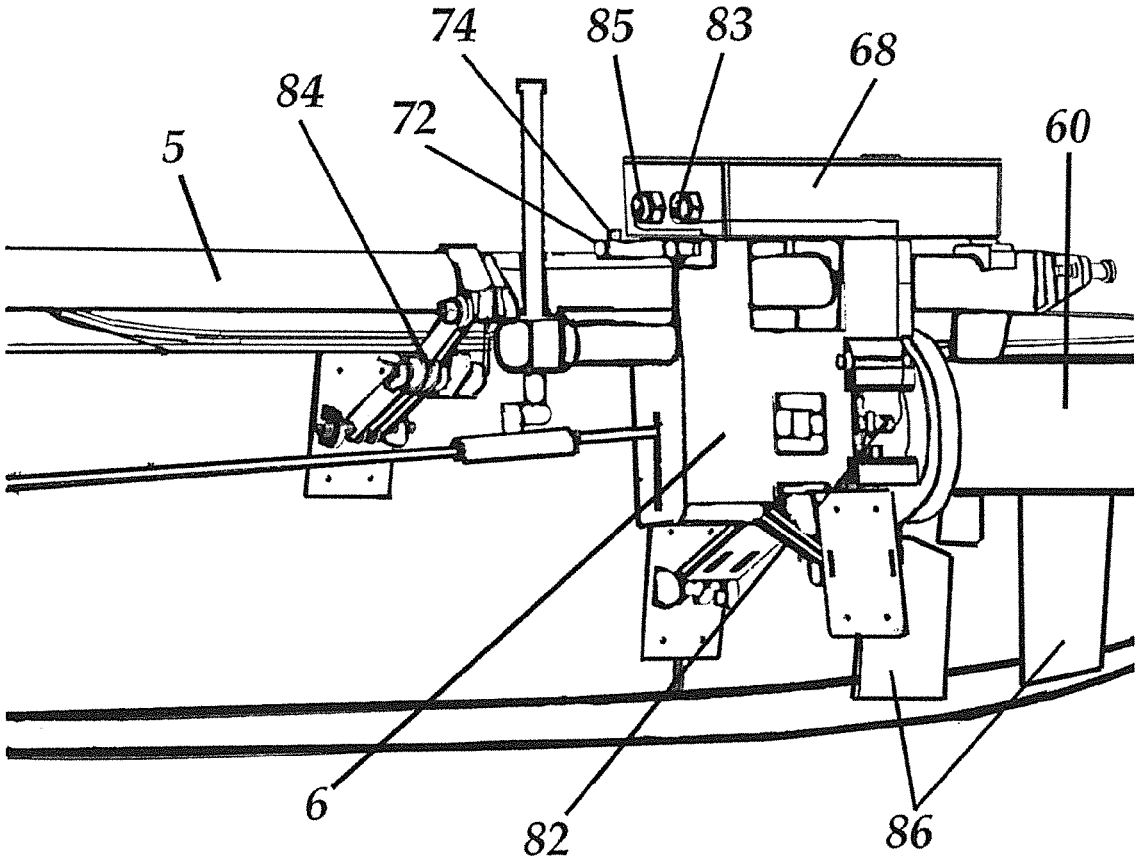
FIG. 12 is a side perspective view of a portion of the propulsion system showing a propeller speed feedback sensor and a mechanical resistance device.

A rotational velocity sensor 82 is shown in FIG. 12. This sensor measures the speed the motor is spinning the propeller and sends the data as a propeller speed feedback signal to 83. This signal may be used as input to the logic unit 68 to control the speed of the motor. A rotational resistance system 84 controls the amount of force required to turn the center bar with respect to a pontoon. Because the center bar is mechanically connected to the center unit and both pontoons, the rotational resistance system determines how much the pontoons move relative to each other as the user shifts his or her weight between the foot chambers in the pontoons. The resistance system could alternatively be placed between other mechanical connections. The amount of resistance may be controlled by the logic unit 68 using a resistance signal from 85.

FIG. 12 also illustrates heat dissipation surfaces 86 which are attached to the center unit, including the motor which is mounted on the center unit. These heat dissipation surfaces extend downward in a generally vertical manner, but tilt with the movement of the center unit. They are made of heat conductive materials to dissipate heat from the motor and the logic unit and are shaped in a streamlined fashion so they may function as fins.

Figure 13:
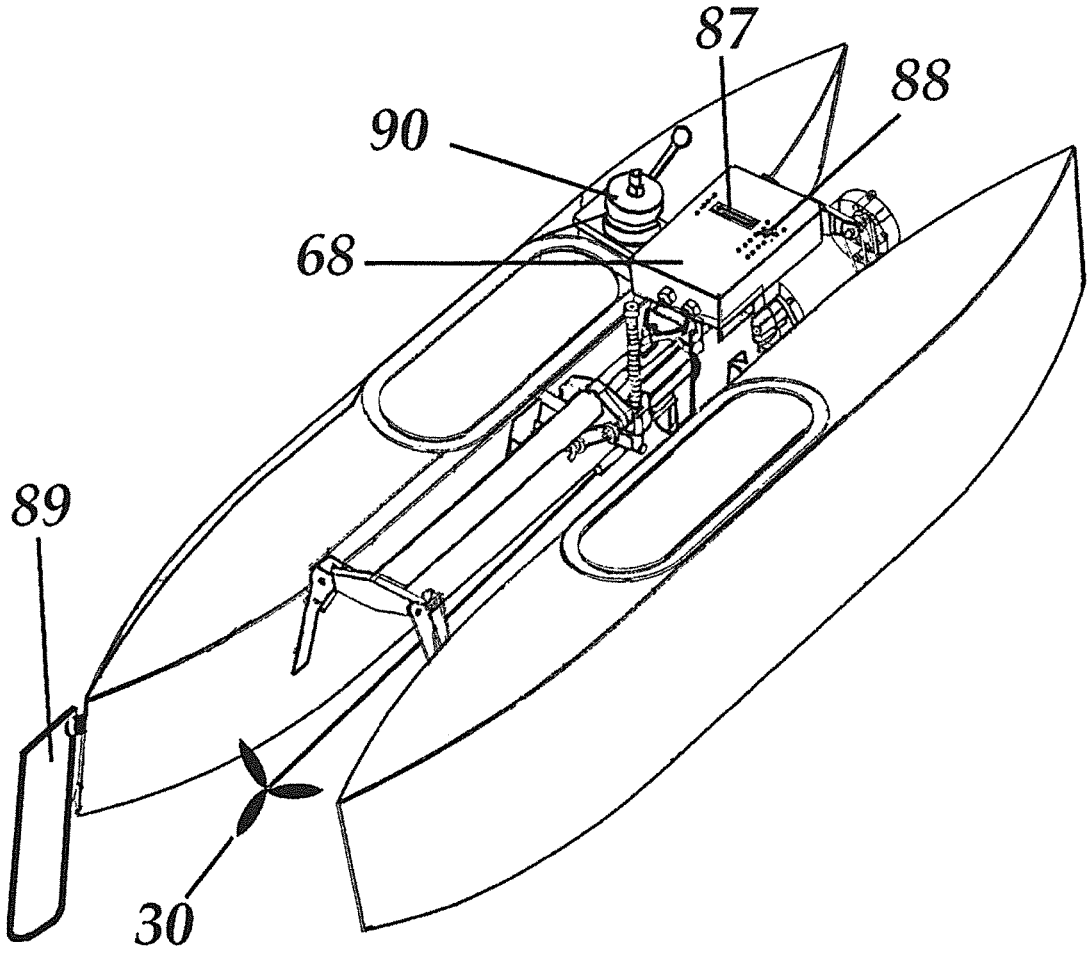
FIG. 13 is a perspective view of an embodiment of the present invention showing a rudder system and the display and input system of an electrical system.

A top perspective is shown in FIG. 13, which illustrates how a user may communicate with the microprocessor-controlled logic unit 68 using control inputs 88 and a display 87. A user can turn the apparatus by shifting his or her weight or using the paddles. In addition, a rudder 89 may be attached to a pontoon and controlled by a rudder wheel 90.

Figure 14:
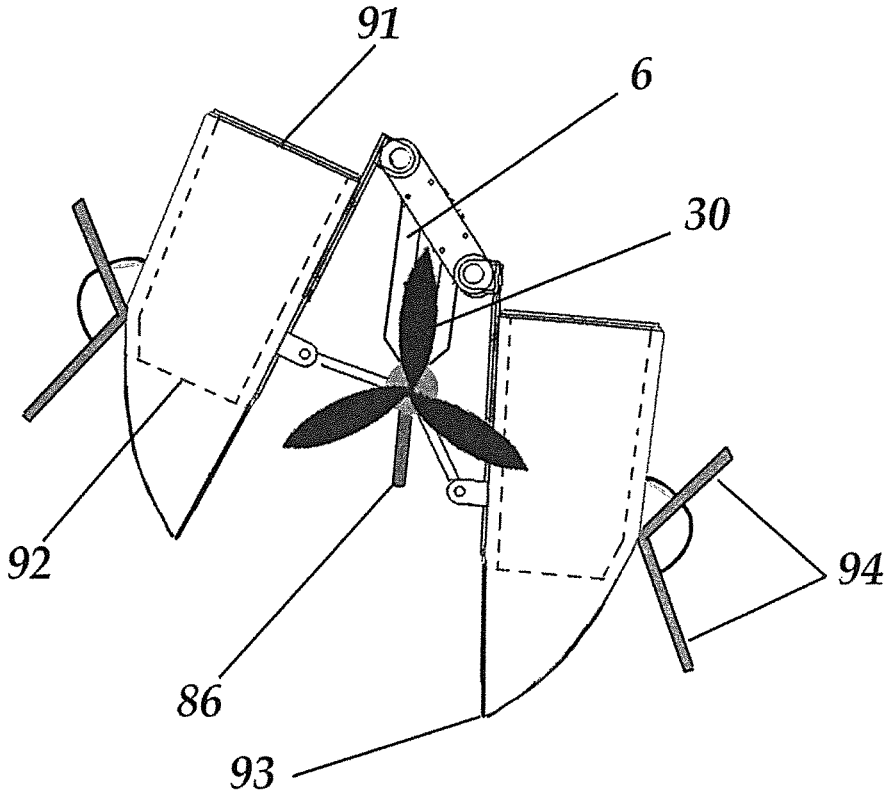
FIG. 14 is a aft view of an embodiment of the present invention showing fins, pontoon shape and foot chamber shape.

FIG. 14 is view from aft of the invention illustrating the opening of the foot chambers 91 and the bottom of the foot chambers 92. The position of the feet and the shape of the pontoon's bottom 93 are designed to influence the lateral movement of the pontoons during the vertical shifting of the user's weight. Pontoon side fins 94 are shown extending from the outward surface of the pontoons. A combination of fins may be used to increase stability while managing the vertical footprint of the fins. The angles of the fins may be adjustable to control the vertical footprint as the pontoons move upward and downward and to improve the water flow as the angles of the pontoons change.

Figure 15:
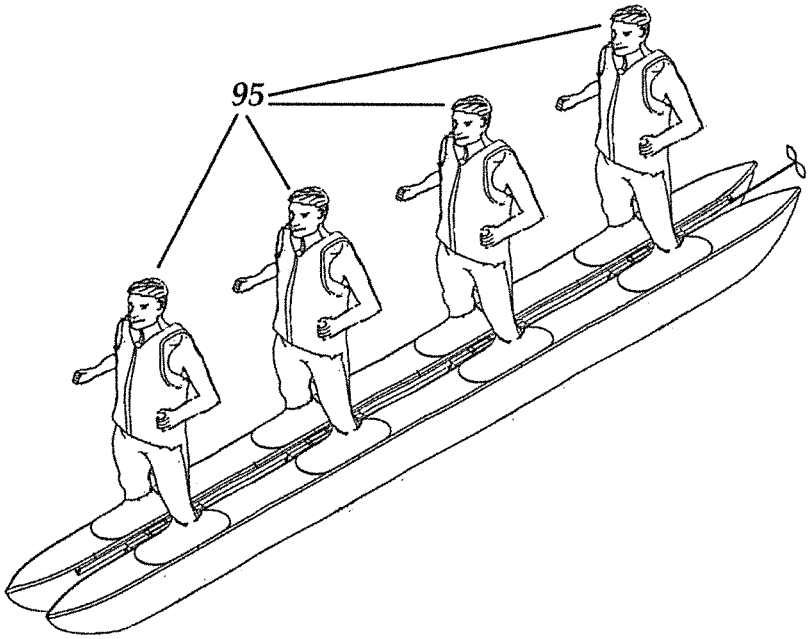
FIG. 15 is perspective view of an embodiment of the apparatus with multiple users sharing the two pontoons.

FIG. 15 shows a perspective of the apparatus in which multiple users 95 share two pontoons and move them in unison.

As will be clear to those of skill in the art, the various elements of the embodiments of the invention may be used in any combination, not limited by the illustrated examples. Further, the embodiments of the present invention illustrated and discussed herein may be altered in various ways without departing from the scope or teaching of the present invention. It is the following claims, including all equivalents, which define the scope of the invention.

The invention claimed is:

1. An apparatus for floatation and propulsion of a user on a body of water with the user in a standing position, the apparatus comprising:

a starboard pontoon and a port pontoon each configured to receive a foot of a user for supporting the user on a body of water;

a mechanical system connecting the pontoons to each other such that the pontoons are disposed parallel to each other, the mechanical system allowing the pontoons to articulate generally vertically relative to each other and relative to the mechanical system, each pontoon having at least one up position, at least one down position and a neutral position between the up and down positions, the mechanical system allowing coordinated articulation of the pontoons such that when one pontoon is in an up position, the other pontoon is in a down position and when one pontoon moves upwardly the other pontoon moves downwardly, the pontoons being generally vertically aligned when the pontoons are each in the neutral position; and a propulsion system comprising a propeller and; a linkage coupled to the mechanical system that drives the propeller as the pontoons articulate; or a motor operable to drive the propeller, wherein a power output of the motor is controlled by the articulation of the pontoons; whereby the propulsion system is responsive to the vertical articulation of the pontoons.

2. An apparatus in accordance with claim 1, wherein the mechanical system includes a center bar that is pivotally interconnected with the starboard pontoon and with the port pontoon.

3. An apparatus in accordance with claim 2, wherein the linkage includes:

a center unit having an upper end pivotally interconnected to the center bar;

a port pontoon bar having an outer end pivotally interconnected to the port pontoon and an inner end pivotally interconnected to a lower end of the center unit; and a starboard pontoon bar having an outer end pivotally interconnected to the starboard pontoon and an inner end pivotally interconnected to a lower end of the center unit.

4. An apparatus in accordance with claim 3, wherein the center bar is pivotally interconnected with an upper portion of each pontoon and the pontoon bars are pivotally interconnected with a lower portion of a respective one of the pontoons.

5. An apparatus in accordance with claim 2, wherein the linkage includes a pair of links connected to the center bar, the links further connected to a one-direction shaft through one way clutches.

6. An apparatus in accordance with claim 5, wherein the propulsion system comprises a propeller shaft and the propeller supported on the shaft, the propeller shaft being in mechanical communication with the one-direction shaft, the propeller shaft being disposed between the pontoons and generally parallel thereto.

7. An apparatus in accordance with claim 2, wherein the linkage mechanical system further includes a system of cables and drums operable to drive the propeller propulsion system as the pontoons articulate.

8. An apparatus in accordance with claim 1, wherein each pontoon has a lower surface for engaging the body of water and an upper surface, the upper surface having an opening defined therein for receiving the user's foot, each pontoon further having an inner side surface and an outer side surface extending between the upper and lower surfaces.

9. An apparatus in accordance with claim 1, wherein an upper portion of each pontoon is tilted inwardly with respect to a lower portion of the respective pontoon when in the neutral position.

10. An apparatus in accordance with claim 9, wherein the upper portion of each pontoon tilts further inwardly as the respective pontoon moves from the neutral position to the at least one up position and tilts outwardly as the respective pontoon moves from the neutral position to the at least one down position.

11. An apparatus in accordance with claim 1, further comprising a control operable to control the output of the motor.

12. An apparatus in accordance with claim 11, wherein the control includes a microprocessor-controlled logic unit having a visual display, the display supported on the mechanical system.

13. An apparatus in accordance with claim 1, wherein the apparatus includes a center unit, the motor being supported by the center unit, the apparatus further comprising at least one heat dissipation fin in thermal communication with the motor, the fin extending downwardly from the center unit.

14. An apparatus in accordance with claim 1, wherein the propulsion system includes a propeller shaft extending between the pontoons and generally parallel to the pontoons, the propulsion system further including a propeller supported on the propeller shaft.

15. An apparatus in accordance with claim 14, further comprising a propeller lifting system operable to raise the propeller upwardly.

16. An apparatus in accordance with claim 14, wherein each of the pontoons has an indentation defined in an inner surface of the pontoon to provide clearance for the propeller.

17. An apparatus in accordance with claim 1, wherein the mechanical system further comprises an adjustable resistance system for adjusting the amount of force required to articulate the pontoons.

18. An apparatus in accordance with claim 1, further comprising:

a sensor operable to send rotational acceleration of the apparatus about a lateral axis;

a control in communication with the sensor and operable to disable the propeller if an angle or angular speed of a front portion of the apparatus exceed predetermined values associated with a user falling.

* * * * *